US010364097B2

(12) United States Patent
O'Brien

(10) Patent No.: US 10,364,097 B2
(45) **Date of Patent: *Jul. 30, 2019**

(54) TRASH BAG SECURING SYSTEM

(71) Applicant: Brian Boru O'Brien, Glen Gardner, NJ (US)

(72) Inventor: Brian Boru O'Brien, Glen Gardner, NJ (US)

( * ) Notice: Subject to any disclaimer, the term of this patent is extended or adjusted under 35 U.S.C. 154(b) by 243 days.

This patent is subject to a terminal disclaimer.

(21) Appl. No.: 15/339,921

(22) Filed: Oct. 31, 2016

(65) Prior Publication Data

US 2017/0043949 A1 Feb. 16, 2017

Related U.S. Application Data

(63) Continuation of application No. 14/284,649, filed on May 22, 2014, now Pat. No. 9,481,514.

(60) Provisional application No. 61/826,363, filed on May 22, 2013.

(51) Int. Cl.
*B65F 1/06* (2006.01)

(52) U.S. Cl.
CPC ..... *B65F 1/06* (2013.01)

(58) Field of Classification Search
CPC ..... B65D 33/00; B65D 33/16; B65D 33/30; B65F 1/00; B65F 1/04; B65F 1/06; B65F 1/14
USPC ..... 220/495.06, 495.08, 495.11, 908, 908.1; 248/95, 99–101
See application file for complete search history.

(56) References Cited

U.S. PATENT DOCUMENTS

| | | | | |
|---|---|---|---|---|
| 380,861 | A * | 4/1888 | Collins | B65D 5/643 229/125.38 |
| 579,228 | A * | 3/1897 | Frame | B65B 67/1205 141/390 |
| 752,574 | A * | 2/1904 | Moses | B65D 5/68 229/125.22 |
| 1,725,526 | A * | 8/1929 | Kondolf | B65D 5/4283 229/122.34 |
| 2,092,969 | A | 9/1937 | Gustafson et al. | |
| 2,327,095 | A | 8/1943 | Cleary | |
| 2,340,124 | A * | 1/1944 | Hoyt | B65D 1/22 220/323 |
| 2,819,008 | A | 1/1958 | White et al. | |
| 3,927,445 | A | 12/1975 | Pavlish | |
| 4,338,979 | A | 7/1982 | Dow | |
| 5,156,328 | A | 10/1992 | Wozniacki | |
| 5,217,271 | A | 6/1993 | Moe | |
| 5,295,606 | A | 3/1994 | Karwoski | |
| D353,696 | S | 12/1994 | Spencer | |
| 5,419,452 | A * | 5/1995 | Mueller | B65F 1/06 220/495.08 |

(Continued)

*Primary Examiner* — Chun Hoi Cheung
*Assistant Examiner* — Brijesh V. Patel
(74) *Attorney, Agent, or Firm* — Kochka Law, LLC; Michael P. Kochka, Esq.

(57) ABSTRACT

A plastic liner receptacle is provided that may include a sidewall comprising an outer rim forming an entrance leading into the receptacle, wherein openings are formed through a single side of the sidewall, and an elastic cord may be directly attached to the receptacle through the openings, wherein the elastic cord is sized and positioned to fit around the outer rim and over a plastic liner such to secure and circumnavigate the plastic liner to the outer rim.

6 Claims, 15 Drawing Sheets

(56) References Cited

U.S. PATENT DOCUMENTS

| | | | | |
|---|---|---|---|---|
| 5,645,186 | A * | 7/1997 | Powers | B65F 1/06 220/495.11 |
| 5,690,247 | A | 11/1997 | Boover | |
| 5,732,845 | A | 3/1998 | Armaly | |
| 5,806,416 | A | 9/1998 | Cerniglia et al. | |
| 6,003,717 | A | 12/1999 | Long | |
| 6,056,147 | A | 5/2000 | Jarman | |
| 6,193,095 | B1 | 2/2001 | McNeil | |
| 6,659,407 | B2 | 12/2003 | Asaro | |
| 7,076,845 | B2 * | 7/2006 | Tylaska | F16G 11/14 24/135 N |
| 7,080,750 | B2 | 7/2006 | Wein et al. | |
| 8,240,621 | B1 | 8/2012 | Singh | |
| 8,827,103 | B1 * | 9/2014 | Engstrom | B65F 1/062 220/495.06 |
| 2005/0017010 | A1 | 1/2005 | Siegel | |
| 2005/0150939 | A1 | 7/2005 | Fakes | |
| 2005/0249439 | A1 | 11/2005 | Penson | |
| 2008/0006637 | A1 * | 1/2008 | Feeney | D06F 95/002 220/495.06 |
| 2008/0061091 | A1 * | 3/2008 | Mailliard | A45F 5/02 224/148.6 |
| 2008/0179330 | A1 | 7/2008 | Brooks et al. | |
| 2009/0050628 | A1 * | 2/2009 | Sullivan | B65F 1/06 220/495.1 |
| 2010/0252557 | A1 * | 10/2010 | Clements | B65F 1/06 220/495.06 |
| 2014/0231435 | A1 * | 8/2014 | McCabe | B65F 1/06 220/495.08 |

* cited by examiner

TRASH BAG SECURING SYSTEM

CROSS-REFERENCE TO RELATED APPLICATIONS

This application is a continuation-in-part of U.S. patent application Ser. No. 14/284,649, filed May 22, 2014, entitled "Trash Bag Securing System," and claims priority to U.S. provisional patent application Ser. No. 61/826,363, filed May 22, 2013, entitled "Subtractive' system of securing a trash bag to a trash receptacle," the disclosures of which are incorporated by reference herein in their entireties as if fully set-forth herein.

BACKGROUND

The present disclosure relates to a trash bag securing system and, more particularly, to an elastic cord attached to a trash receptacle.

Typically, trash bags are not securely fastened to trash receptacles. In most cases, the bag is merely folded over the top rim of the receptacle. Often when the bag is empty and when a heavy piece of trash is thrown into the bag, the weight of the item overwhelms the trash bag causing it to collapse on itself and fall into the bottom of the receptacle.

Currently, other devices and methods to remedy the above mentioned problem are more complex, often an expensive additive, and achieve only partial results. Other devices may include clamps, springs, loops and hooks to secure the trash bag to the rim; they may also use clamps, springs, loops, hooks and, even additional elastic cords, to anchor the primary elastic cord to the receptacle. Most do not secure the bag around 100% of the rim of the receptacle and if they do, they do so in such a way that does not allow for adjustments that can create customized tension around the rim of the receptacle. Furthermore, the weight, bulk, and cost to manufacture these existing items make them impractical for use in a home or office.

As can be seen, there is a need for an improved trash bag securing system, especially for the home and office.

SUMMARY

In one aspect of the present disclosure, a trash bag securing system comprises: a trash receptacle comprising at least one sidewall comprising an outer surface and an inner surface, wherein a receptacle is formed within the inner surface, wherein the at least one sidewall comprises a rim forming an entrance leading into the receptacle, wherein at least one opening is formed through the sidewall; an elastic cord is attached to the trash receptacle through the at least one opening, wherein the elastic cord is sized to fit around the outer surface of the sidewall.

These and other features, aspects and advantages of the present disclosure will become better understood with reference to the following drawings, description and claims.

BRIEF DESCRIPTION OF THE DRAWINGS

So the manner in which the above recited features of the present disclosure can be understood in detail, a more particular description of embodiments of the present disclosure, briefly summarized above, may be had by reference to embodiments, which are illustrated in the appended drawings. It is to be noted, however, the appended drawings illustrate only typical embodiments of embodiments encompassed within the scope of the present disclosure, and, therefore, are not to be considered limiting, for the present disclosure may admit to other equally effective embodiments, wherein.

Figure 1:
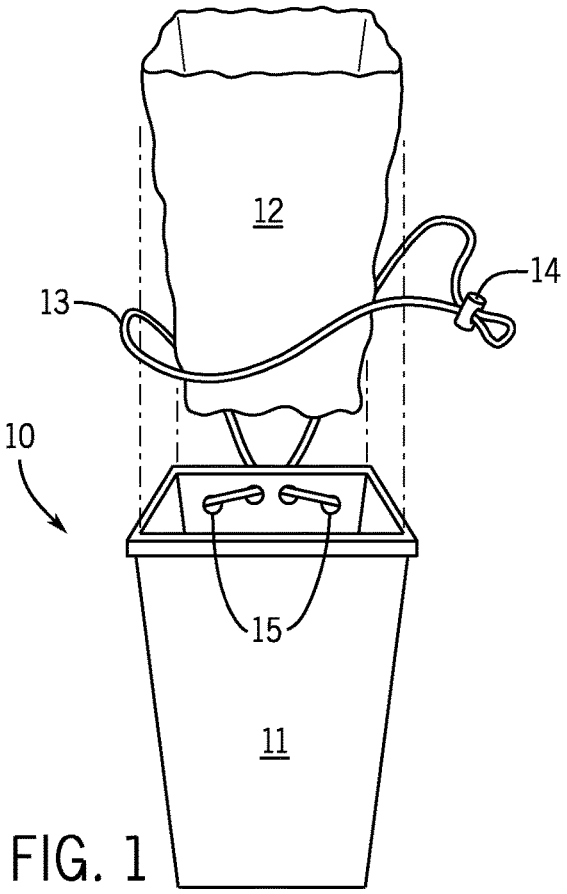
FIG. 1 is a front exploded perspective view of the first embodiment of the present disclosure just prior to use.
Figure 2:
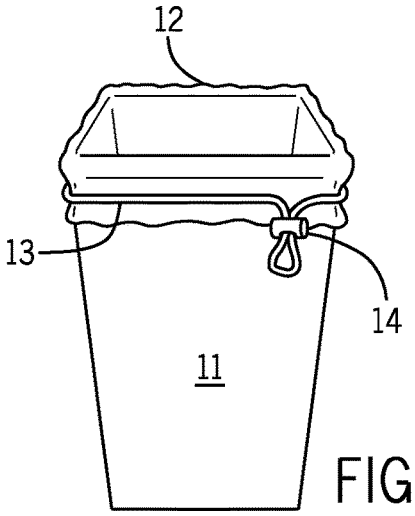
FIG. 2 is a front perspective view of the first embodiment of the present disclosure in use.
Figure 3:
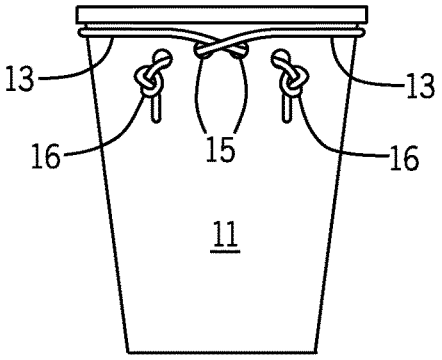
FIG. 3 is a rear elevation view of the first embodiment of the present disclosure without the trash bag showing the arrangement of the elastic cord.
Figure 4:
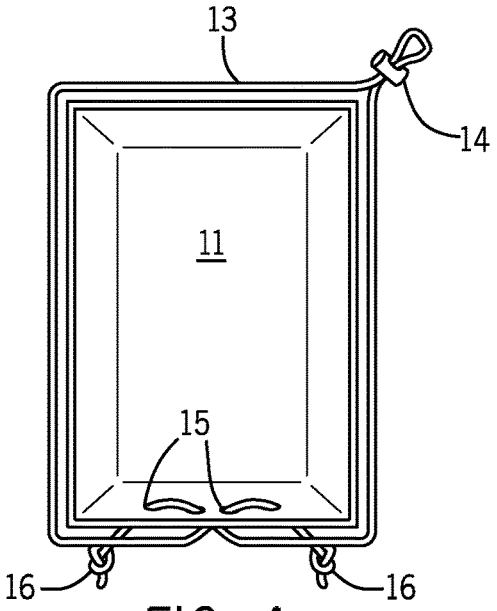
FIG. 4 is a top plan view of the first embodiment of the present disclosure without the trash bag showing the arrangement of the elastic cord.
Figure 5:
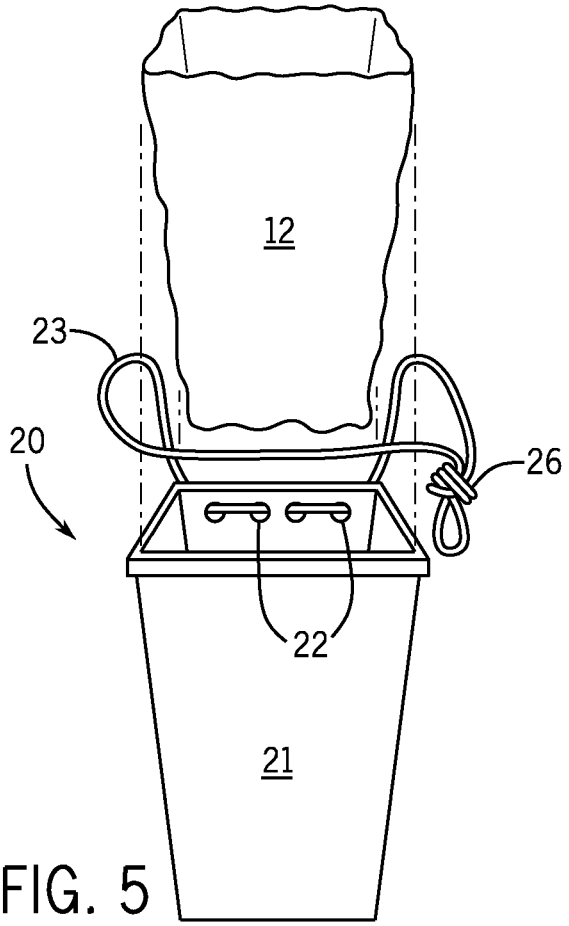
FIG. 5 is a front exploded perspective view of the second embodiment of the present disclosure just prior to use.
Figure 6:
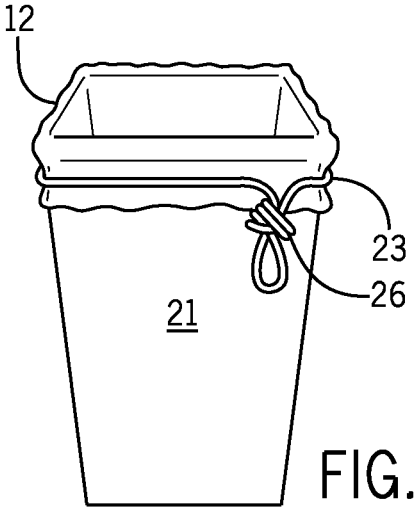
FIG. 6 is a front perspective view of the second embodiment of the present disclosure in use.
Figure 7:
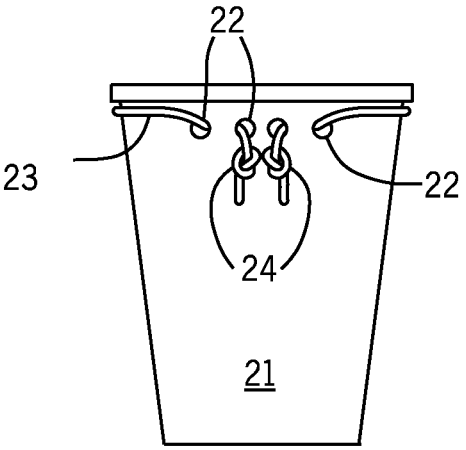
FIG. 7 is a rear elevation view of the second embodiment of the present disclosure without the trash bag showing the arrangement of the elastic cord.
Figure 8:
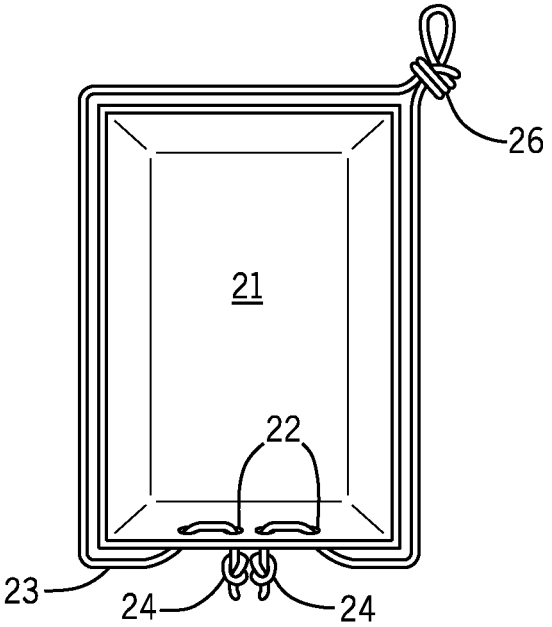
FIG. 8 is a top plan view of the second embodiment of the present disclosure without the trash bag showing the arrangement of the elastic cord.
Figure 9:
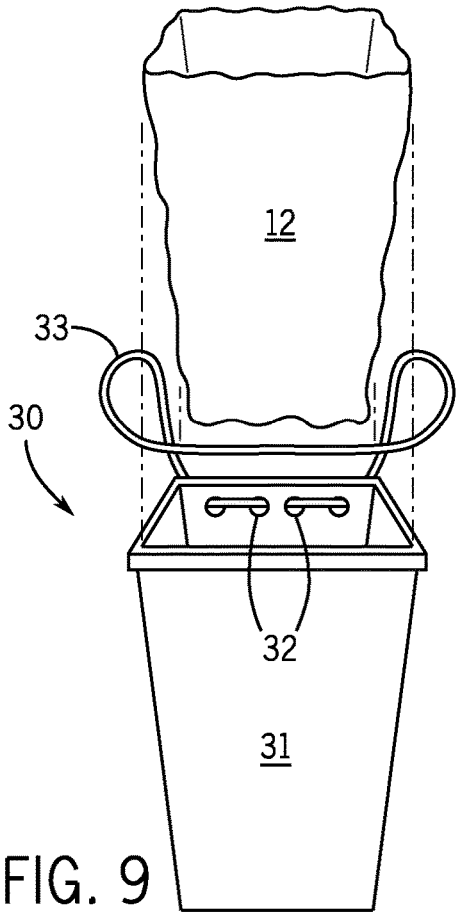
FIG. 9 is a front exploded perspective view of the third embodiment of the present disclosure just prior to use.
Figure 10:
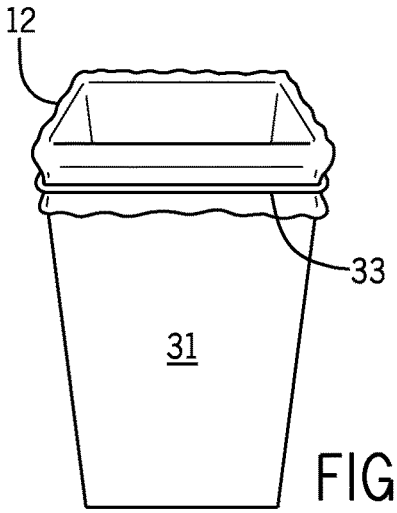
FIG. 10 is a front perspective view of the third embodiment of the present disclosure in use.
Figure 11:
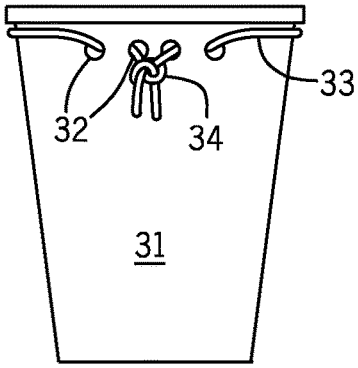
FIG. 11 is a rear elevation view of the third embodiment of the present disclosure without the trash bag showing the arrangement of the elastic cord.
Figure 12:
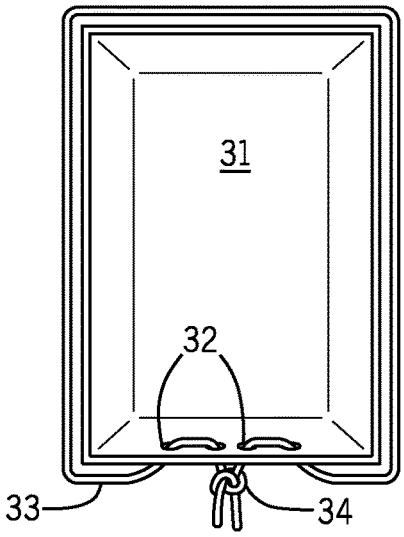
FIG. 12 is a top plan view of the third embodiment of the present disclosure without the trash bag showing the arrangement of the elastic cord.
Figure 13:
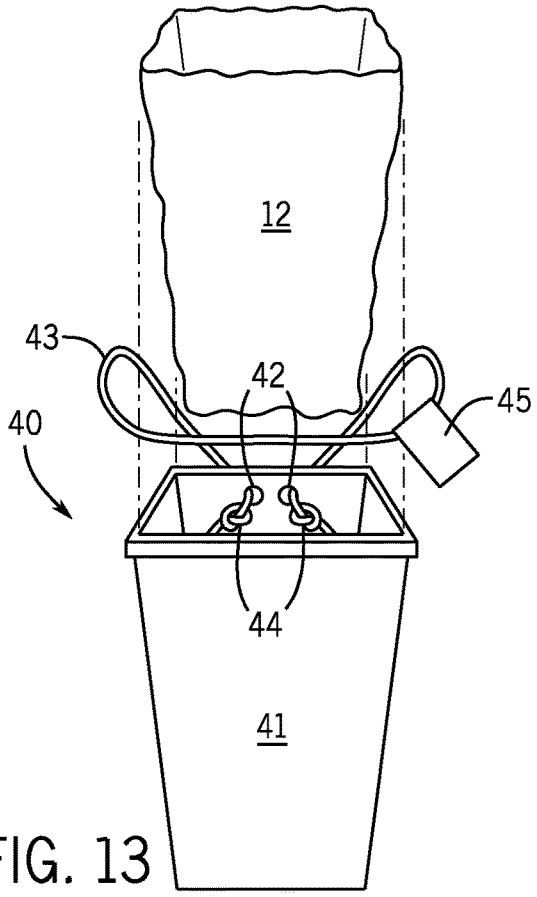
FIG. 13 is a front exploded perspective view of the fourth embodiment of the present disclosure just prior to use.
Figure 14:
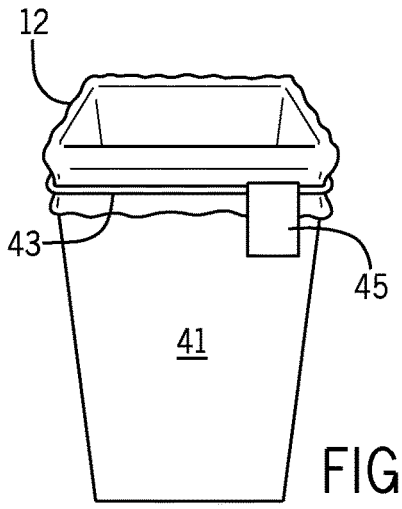
FIG. 14 is a front perspective view of the fourth embodiment of the present disclosure in use.
Figure 15:
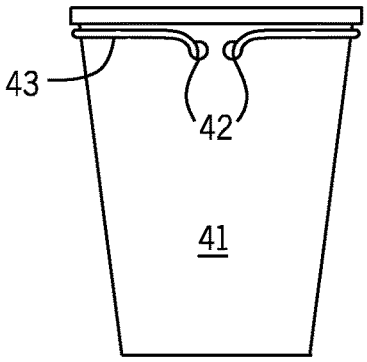
FIG. 15 is a rear elevation view of the fourth embodiment of the present disclosure without the trash bag showing the arrangement of the elastic cord.
Figure 16:
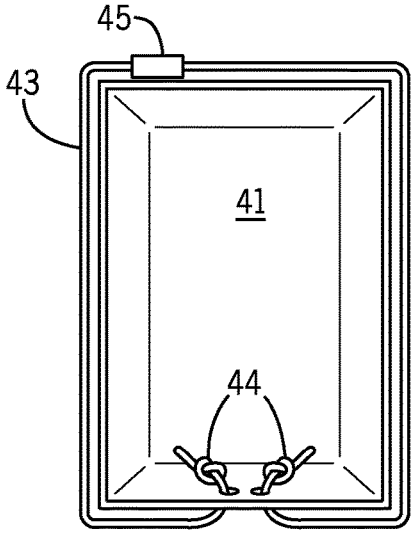
FIG. 16 is a top plan view of the fourth embodiment of the present disclosure without the trash bag showing the arrangement of the elastic cord.
Figure 17:
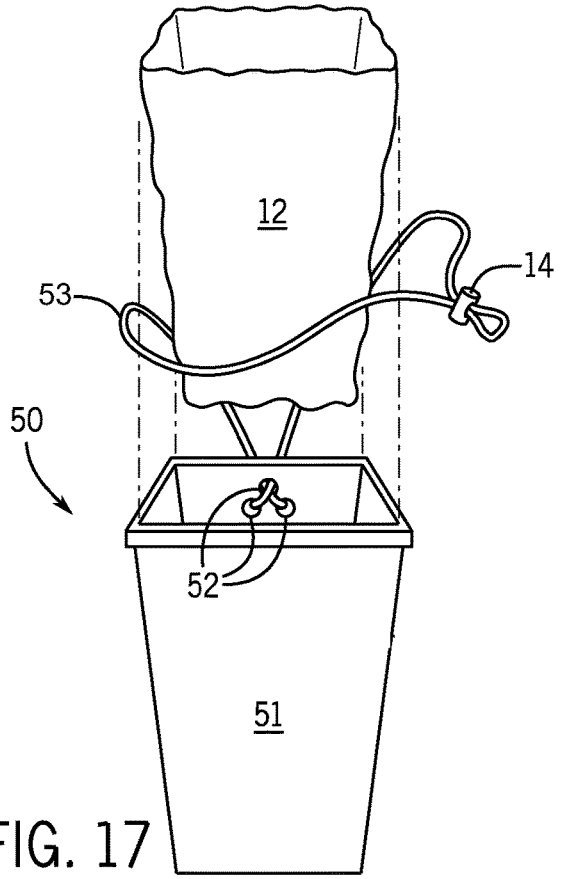
FIG. 17 is a front exploded perspective view of the fifth embodiment of the present disclosure just prior to use.
Figure 18:
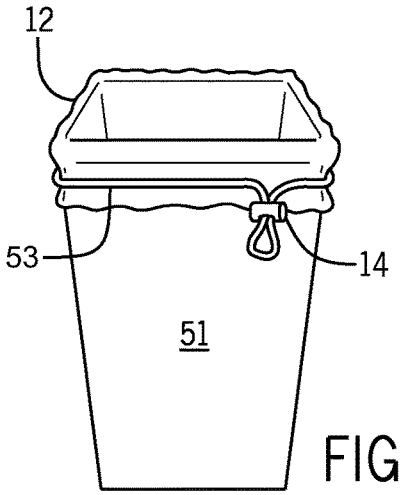
FIG. 18 is a front perspective view of the fifth embodiment of the present disclosure in use.
Figure 19:
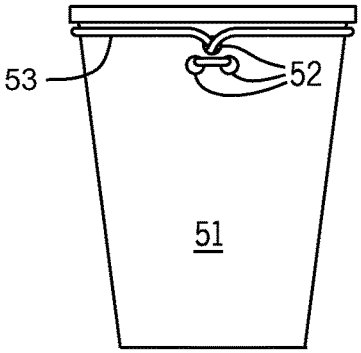
FIG. 19 is a rear elevation view of the fifth embodiment of the present disclosure without the trash bag showing the arrangement of the elastic cord.
Figure 20:
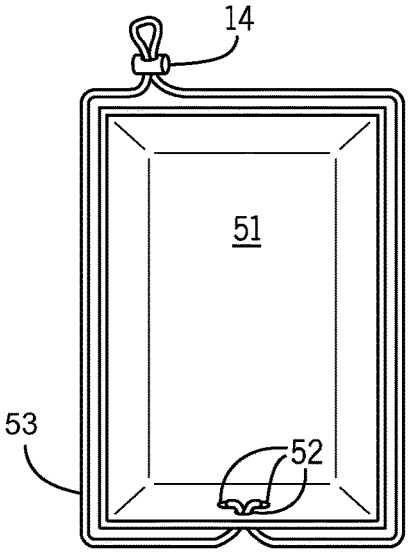
FIG. 20 is a top plan view of the fifth embodiment of the present disclosure without the trash bag showing the arrangement of the elastic cord.
Figure 21:
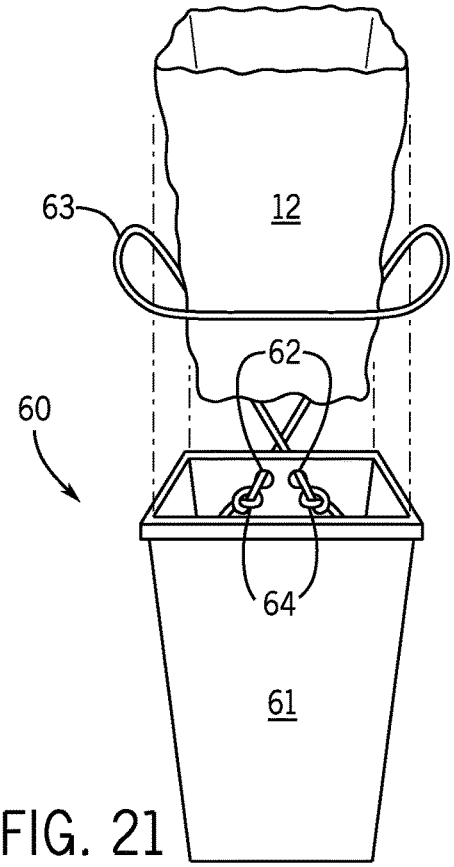
FIG. 21 is a front exploded perspective view of the sixth embodiment of the present disclosure just prior to use.
Figure 22:
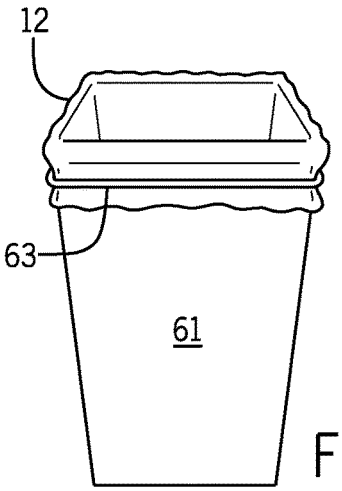
FIG. 22 is a front perspective view of the sixth embodiment of the present disclosure in use.
Figure 23:
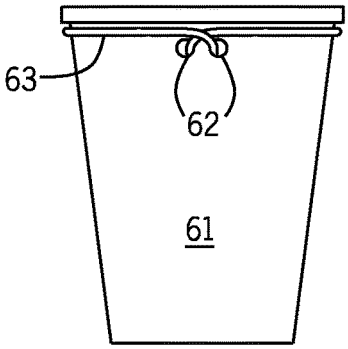
FIG. 23 is a rear elevation view of the sixth embodiment of the present disclosure without the trash bag showing the arrangement of the elastic cord.
Figure 24:
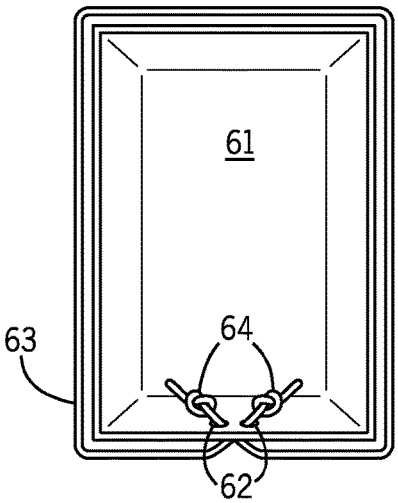
FIG. 24 is a top plan view of the sixth embodiment of the present disclosure without the trash bag showing the arrangement of the elastic cord.
Figure 25:
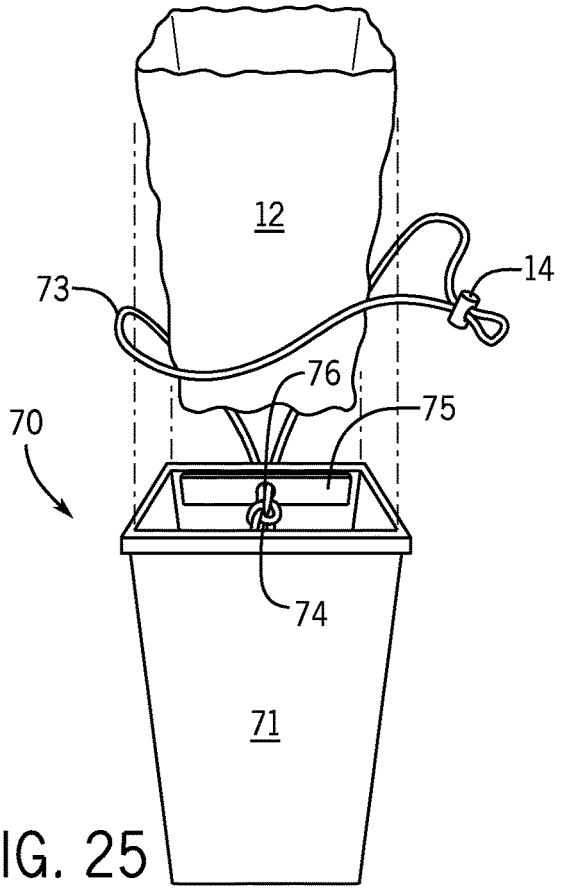
FIG. 25 is a front exploded perspective view of the seventh embodiment of the present disclosure just prior to use.
Figure 26:
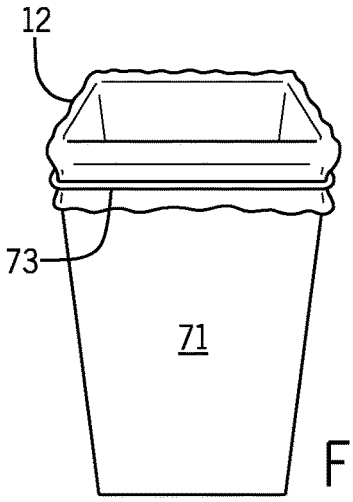
FIG. 26 is a front perspective view of the seventh embodiment of the present disclosure in use.
Figure 27:
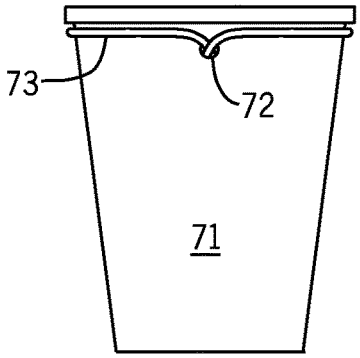
FIG. 27 is a rear elevation view of the seventh embodiment of the present disclosure without the trash bag showing the arrangement of the elastic cord used with a reinforcement.
Figure 28:
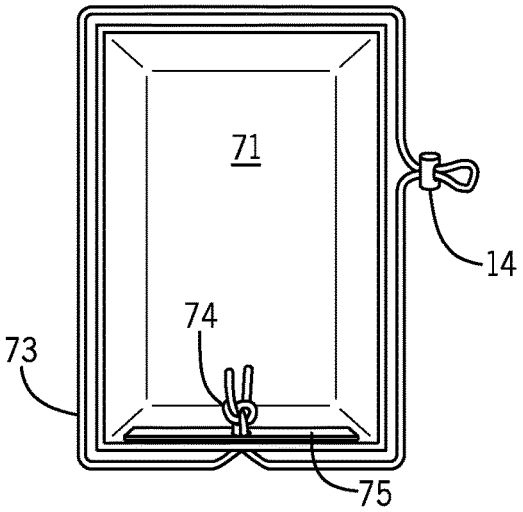
FIG. 28 is a top plan view of the seventh embodiment of the present disclosure without the trash bag showing the arrangement of the elastic cord used with a reinforcement.
Figure 29:
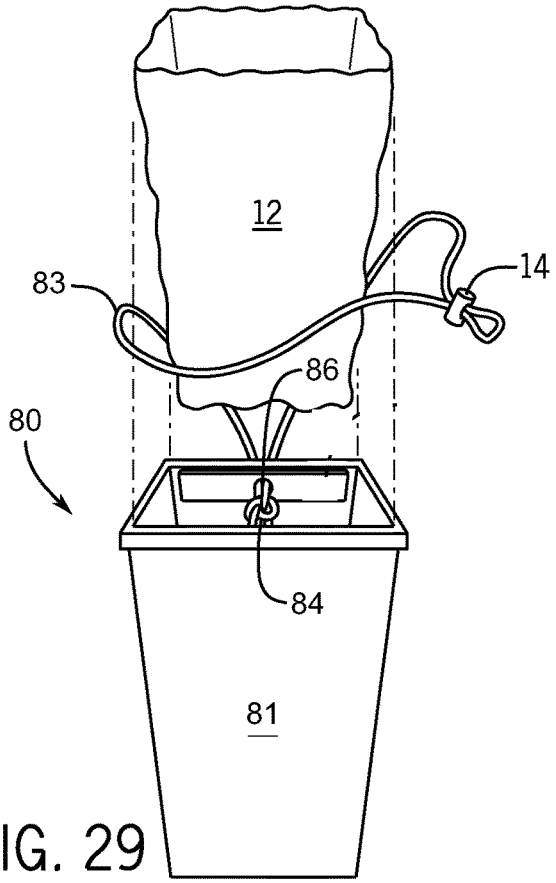
FIG. 29 is a front exploded perspective view of the eighth embodiment of the present disclosure just prior to use.
Figure 30:
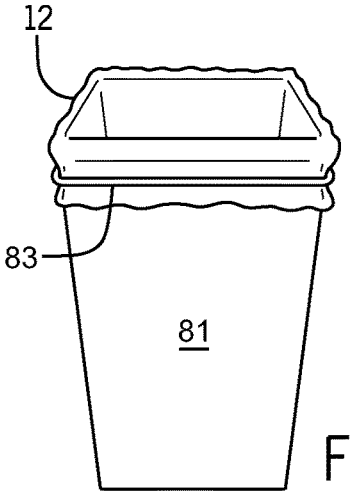
FIG. 30 is a front perspective view of the eighth embodiment of the present disclosure in use.
Figure 31:
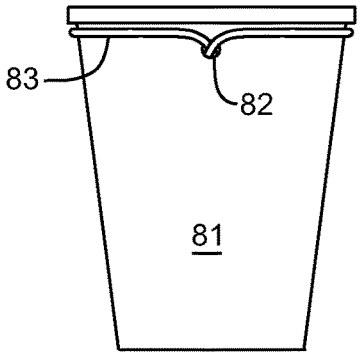
FIG. 31 is a rear elevation view of the eighth embodiment of the present disclosure without the trash bag showing the arrangement of the elastic cord used with a reinforcement.
Figure 32:
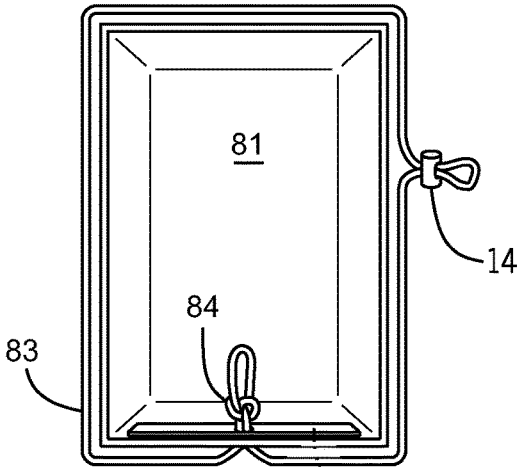
FIG. 32 is a top plan view of the eighth embodiment of the present disclosure without the trash bag showing the arrangement of the elastic cord used with a reinforcement.
Figure 33:
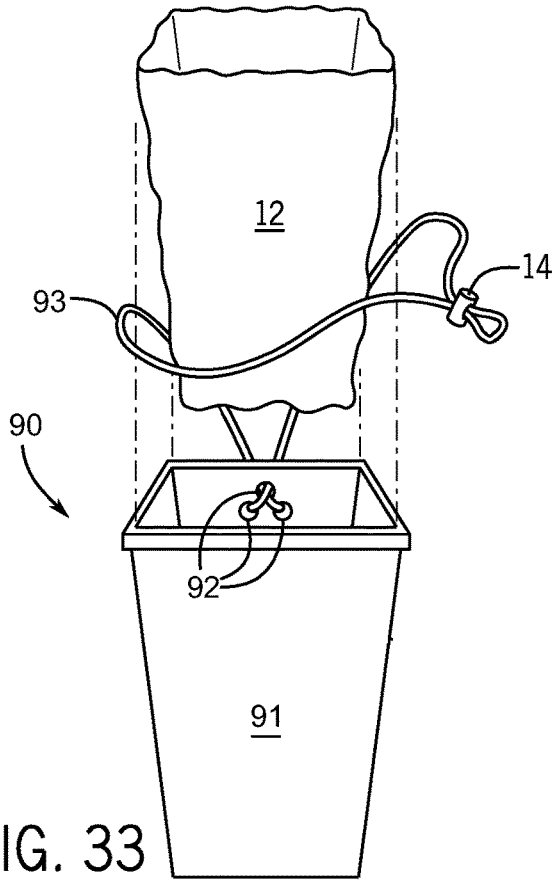
FIG. 33 is a front exploded perspective view of the ninth embodiment of the present disclosure just prior to use.
Figure 34:
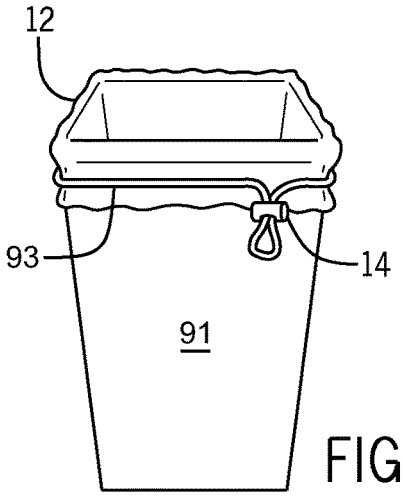
FIG. 34 is a front perspective view of the ninth embodiment of the present disclosure in use.
Figure 35:
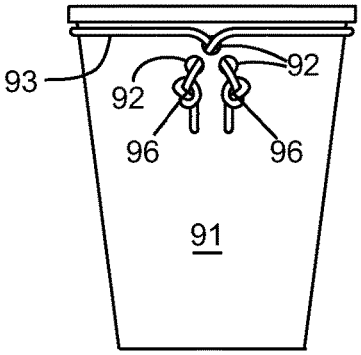
FIG. 35 is a rear elevation view of the ninth embodiment of the present disclosure without the trash bag showing the arrangement of the elastic cord.
Figure 36:
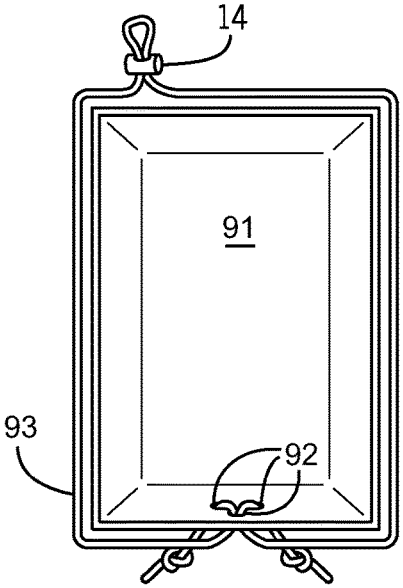
FIG. 36 is a top plan view of the ninth embodiment of the present disclosure without the trash bag showing the arrangement of the elastic cord.
Figure 37:
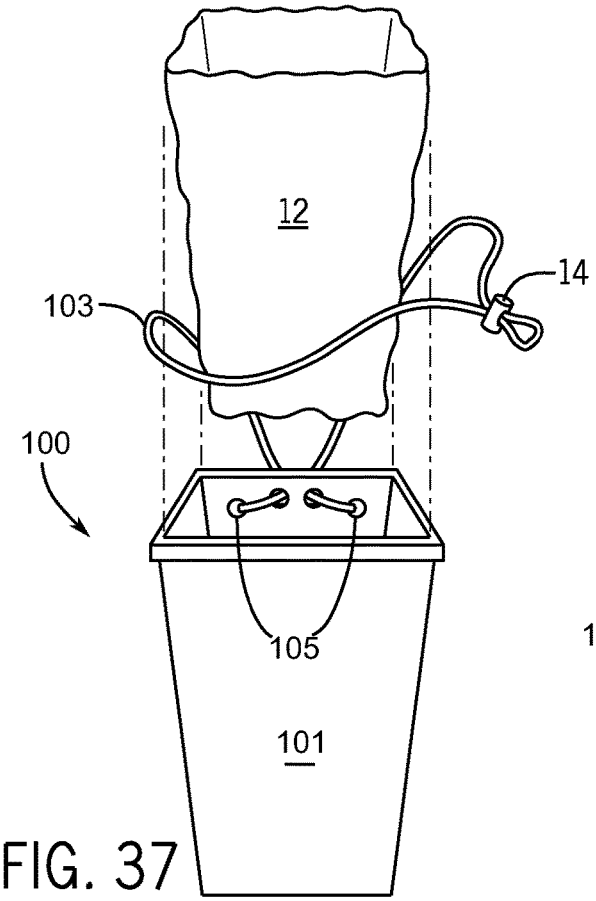
FIG. 37 is a front exploded perspective view of the tenth embodiment of the present disclosure just prior to use.
Figure 38:
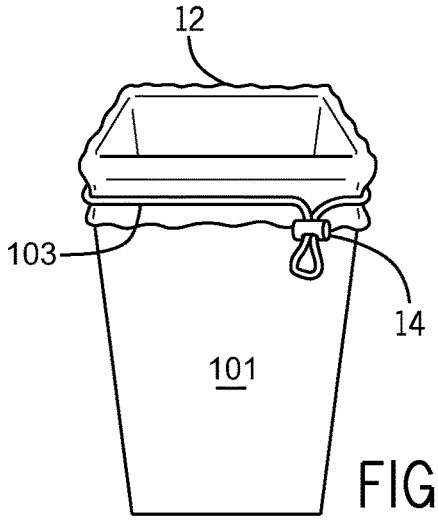
FIG. 38 is a front perspective view of the tenth embodiment of the present disclosure in use.
Figure 39:
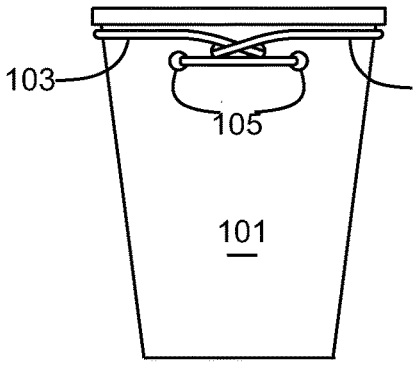
FIG. 39 is a rear elevation view of the tenth embodiment of the present disclosure without the trash bag showing the arrangement of the elastic cord.
Figure 40:
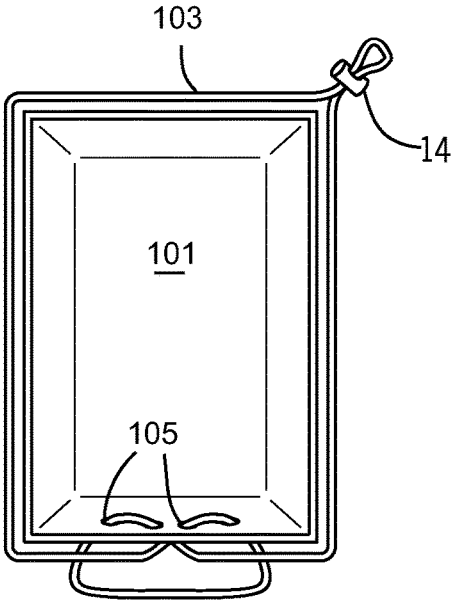
FIG. 40 is a top plan view of the tenth embodiment of the present disclosure without the trash bag showing the arrangement of the elastic cord.
Figure 41:
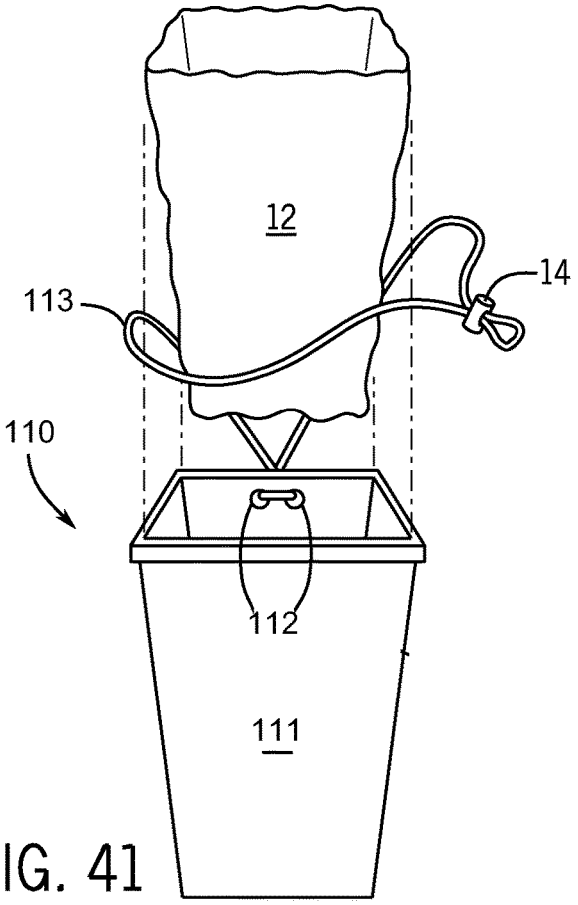
FIG. 41 is a front exploded perspective view of the eleventh embodiment of the present disclosure just prior to use.
Figure 42:
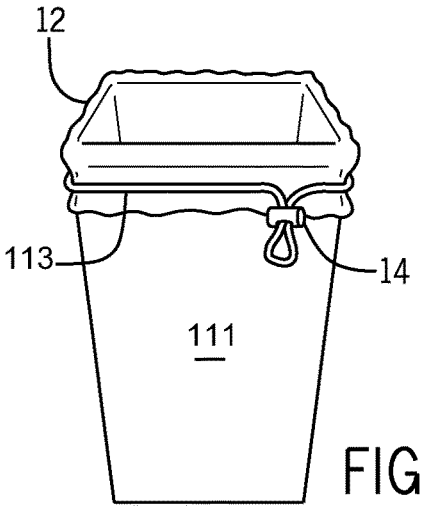
FIG. 42 is a front perspective view of the eleventh embodiment of the present disclosure in use.
Figure 43:
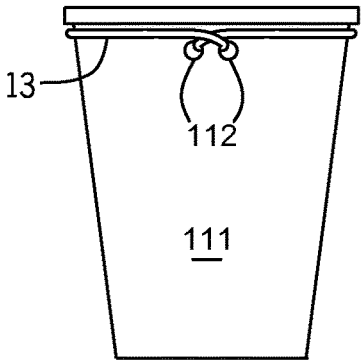
FIG. 43 is a rear elevation view of the eleventh embodiment of the present disclosure without the trash bag showing the arrangement of the elastic cord.
Figure 44:
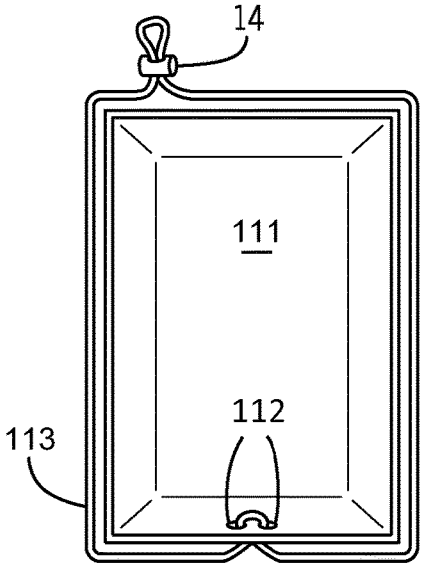
FIG. 44 is a top plan view of the eleventh embodiment of the present disclosure without the trash bag showing the arrangement of the elastic cord.
Figure 45:
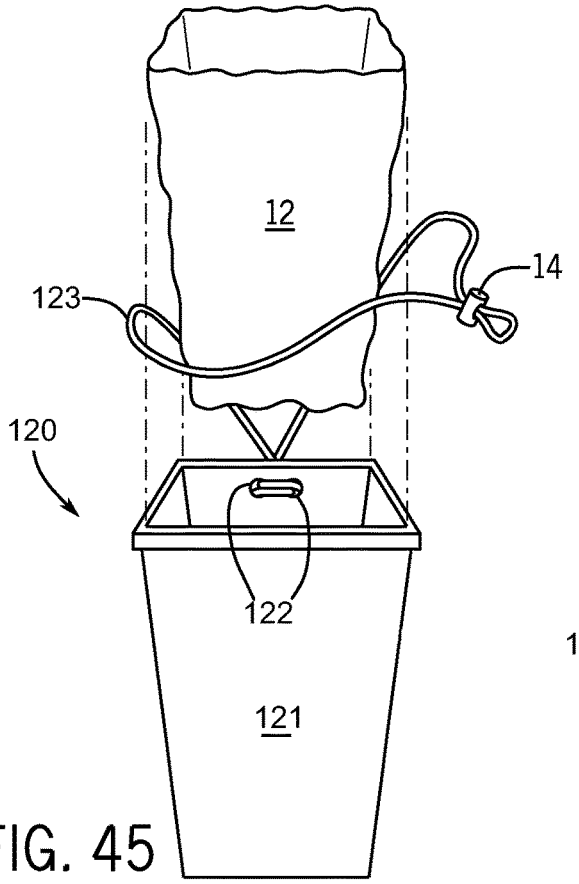
FIG. 45 is a front exploded perspective view of the twelfth embodiment of the present disclosure just prior to use.
Figure 46:
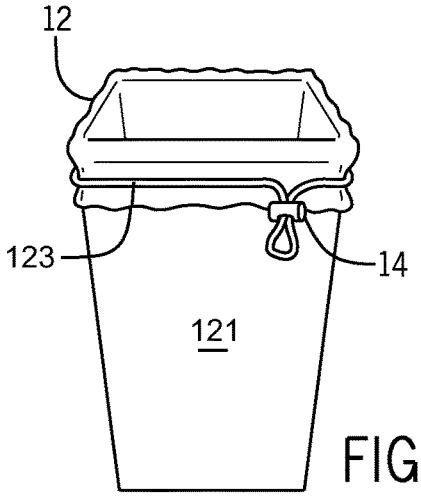
FIG. 46 is a front perspective view of the twelfth embodiment of the present disclosure in use.
Figure 47:
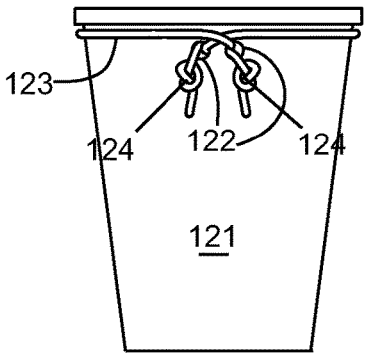
FIG. 47 is a rear elevation view of the twelfth embodiment of the present disclosure without the trash bag showing the arrangement of the elastic cord.
Figure 48:
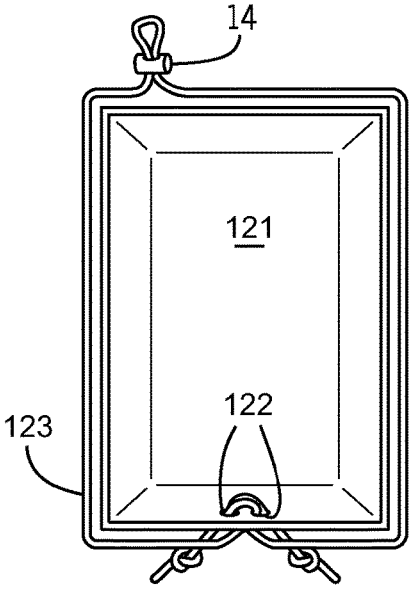
FIG. 48 is a top plan view of the twelfth embodiment of the present disclosure without the trash bag showing the arrangement of the elastic cord.
Figure 49:
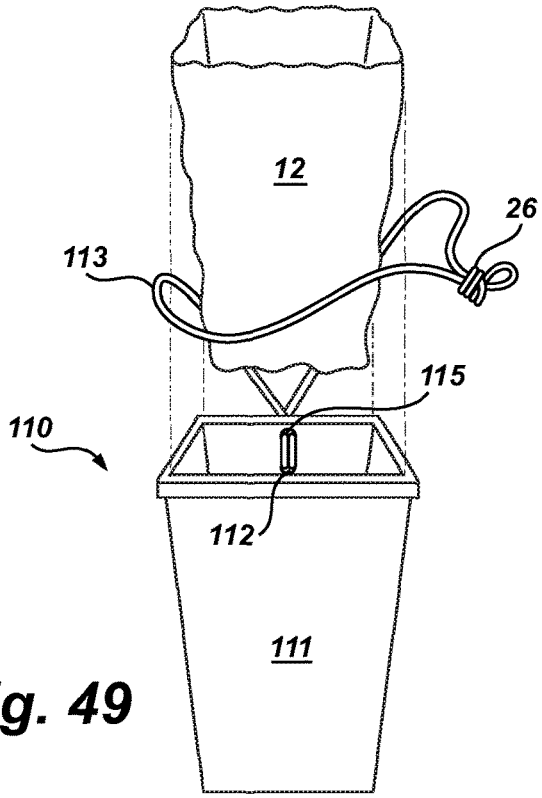
FIG. 49 is a front exploded perspective view of a thirteenth embodiment of the present disclosure just prior to use.
Figure 50:
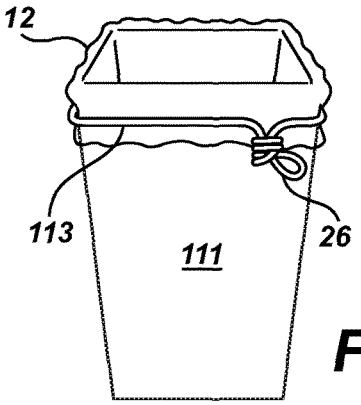
FIG. 50 is a front perspective view of a thirteenth embodiment of the present disclosure in use.
Figure 51:
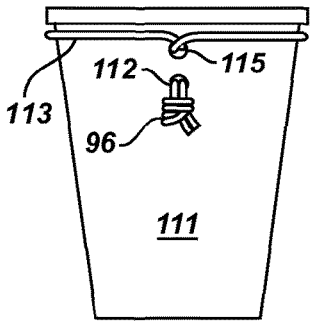
FIG. 51 is a rear view of a thirteenth embodiment of the present disclosure without the trash bag showing the arrangement of the elastic cord.
Figure 52:
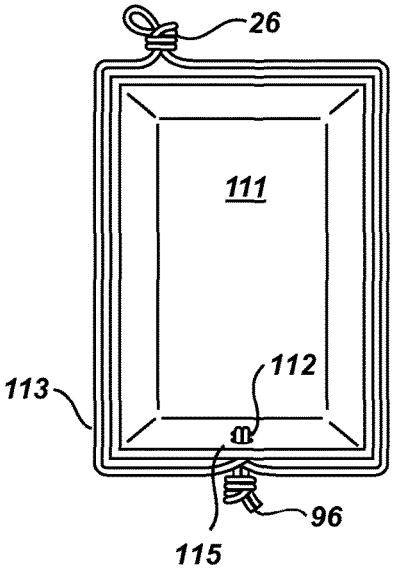
FIG. 52 is a top plan view of a thirteenth embodiment of the present disclosure without the trash bag showing the arrangement of the elastic cord.
Figure 53:
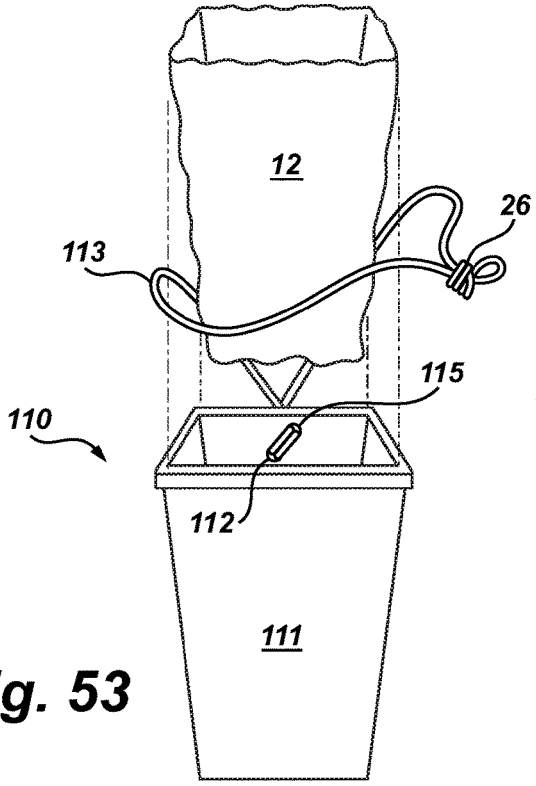
FIG. 53 is a front exploded perspective view of a fourteenth embodiment of the present disclosure just prior to use.
Figure 54:
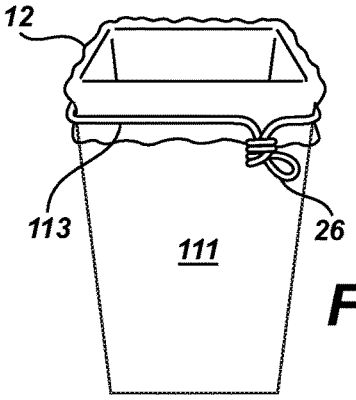
FIG. 54 is a front perspective view of a fourteenth embodiment of the present disclosure in use.
Figure 55:
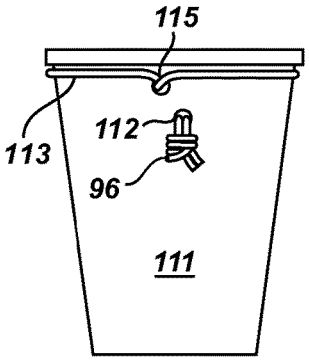
FIG. 55 is a rear view of a fourteenth embodiment of the present disclosure without the trash bag showing the arrangement of the elastic cord.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present disclosure includes a kitchen trash receptacle that securely holds trash bags. The present disclosure securely holds the trash bag open along the entire rim of the trash receptacle, while at the same time, efficiently anchoring the holding device, such as a bungee cord, to the receptacle so the holding device is not lost or misplaced. Further, the present disclosure does not dramatically increase the bulk, cost, or complexity of the kitchen receptacle.

The present disclosure may be used with existing drawer style kitchen trash receptacles. By combining the existing design of a generic trash receptacle with a system of holes, knots and lacing patterns for the elastic band, the present disclosure provides an ideal and novel method for holding trash bags around the rim of any trash receptacle, including bottomless trash receptacles.

Figure 56:
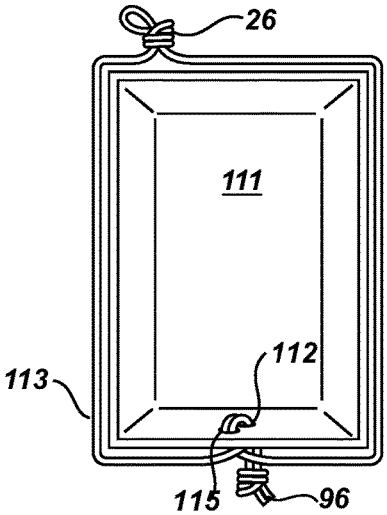
FIG. 56 is a top plan view of a fourteenth embodiment of the present disclosure without the trash bag showing the arrangement of the elastic cord.
Figure 57:
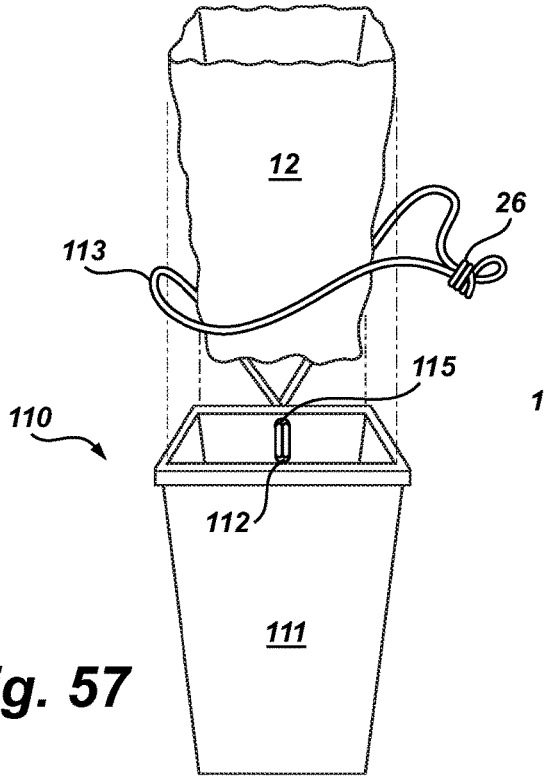
FIG. 57 is a front exploded perspective view of a fifteenth embodiment of the present disclosure just prior to use.
Figure 58:
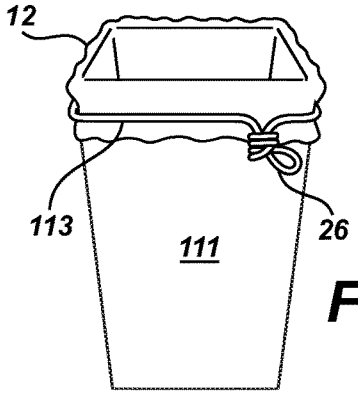
FIG. 58 is a front perspective view of a fifteenth embodiment of the present disclosure in use.
Figure 59:
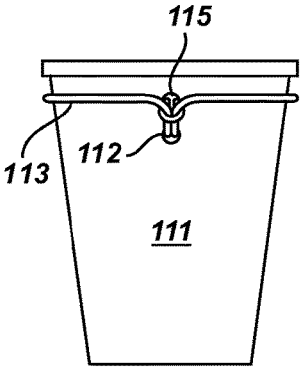
FIG. 59 is a rear view of a fifteenth embodiment of the present disclosure without the trash bag showing the arrangement of the elastic cord.
Figure 60:
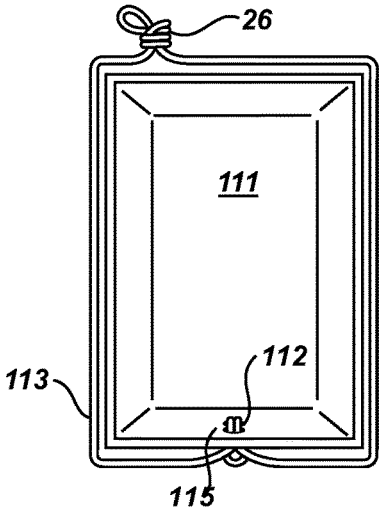
FIG. 60 is a top plan view of a fifteenth embodiment of the present disclosure without the trash bag showing the arrangement of the elastic cord.

Referring to FIGS. 1 through 56, the present disclosure includes a trash bag securing device 10. The trash bag securing device 10 includes a rigid trash receptacle 11. The trash receptacle 11 includes a bottom portion and at least one sidewall extending from the bottom portion. The sidewall includes an inner surface and an outer surface, with the receptacle formed within the inner surface of the sidewall. The sidewall further includes a rim forming an entrance leading into the receptacle. At least one opening 15 is formed through the sidewall. The trash bag securing device 10 may further include an elastic cord 13, such as a stretchable bungee cord 13. The elastic cord 13 is attached to the trash receptacle through the at least one opening 15. The elastic cord 13 is sized to fit snuggly around the outer surface of the sidewall to secure a trash bag 12 to the trash receptacle 11. In certain embodiments, the elastic cord 13 may be a continuous, unbroken loop. In certain embodiments, the elastic cord 13 may be broken with a first and second end.

In certain embodiments, a stopper is formed at ends of the elastic cord 13. The stopper may include a diameter larger than the at least one opening 15 of the trash receptacle 11. The stopper may be achieved by knotting or cinching one end of elastic cord 13 or tying the ends of the elastic cord 13 together. In certain embodiments, a smaller loop may be formed by tying a knot 26 or attaching an adjustable cord lock 14 to a portion of the elastic cord 13. The cord lock 14 may be used to tighten or loosen the elastic cord 13 around the trash receptacle 11. The cord lock 14 may adjust the elastic cord 13 so that the length of the cord 13 is slightly smaller than the perimeter of the rim.

In certain embodiments, a handle may be attached to the elastic cord 13. For example, a tag 45 may be attached to the elastic cord 13 so that a user may easily grasp and manipulate the elastic cord 13. In certain embodiments, the loop formed may also be used as a handle to grasp the elastic cord 13 in order to wrap the cord 13 around the rim or remove the cord 13 from the rim.

The elastic cord 13 may be stretched out and placed over the upper rim of the receptacle 11 so that it can hold itself and any generic trash bag 12 securely in place so that the generic trash bag 12 does not collapse in on itself when a heavy item is thrown into the receptacle 11 or due to heavy gusts. When the user is ready to remove the trash bag 12, the small handle loop formed by the knot 26 or cord lock 14, may be grasped and the elastic cord 13 may be pulled off of the rim of the trash receptacle 11. The elastic cord 13 may be released but remains securely connected to the trash receptacle 11. The full trash bag 12 is removed and the new bag is replaced and held securely open in place in the inside of the receptacle 11 in the same fashion as previously described.

In certain embodiments, the elastic cord 13 may be overlapped over itself so that it may be certain to provide a definitive hold on the trash bag 12 around 100% of the outer rim of the trash receptacle 11.

In certain embodiments, a reinforcement may be utilized with the present disclosure. The reinforcement may include a large knot, a big round button, or a flat rectangular piece of plastic with a hole in it, such as a plate 75. The plate 75 may be fastened to the trash receptacle 11. For example, the plate 75 may be attached to the inner surface of the at least one sidewall. The plate 75 may include at least one opening 76 that aligns with the at least one opening 15, 72 of the sidewall.

In embodiments as illustrated in FIGS. 1 through 4, the trash receptacle 11 may include four sidewalls. The present disclosure may include four openings 15, including two outer openings 15 and two inner openings 15, just below the rim of one of the sidewalls. The elastic cord 13 may include a first end and a second end. The first end may include a knot 16 resting on the outer surface of the sidewall and the elastic cord 13 may run through one of the two outer openings. The elastic cord 13 may then run through an inner opening 15 closest to the outer opening 15 comprising the knot 16 and may run along the rim of the outer surface of the sidewalls. The second end of the elastic cord may run back through the opposite inner opening 15 as the first end and through the opposite outer opening 15 as the first end, where a second knot 16 is formed, thereby securing the elastic cord 13 to the trash receptacle 11 on the outer surface of the sidewalls. The trash bag 12 may be folded over the rim of the trash receptacle 11 and secured in between the elastic cord 13 and the trash receptacle 11.

In embodiments as illustrated in FIGS. 5 through 8, the present disclosure may include four openings 22, including two outer openings 22 and two inner openings 22, just below the rim of one of the sidewalls. The elastic cord 23 may include a first end and a second end. The first end may include a knot 24 resting on the outer surface of the sidewall and the elastic cord 23 may run through one of the two inner openings. The elastic cord 23 may then run through an outer opening 22 closest to the inner opening 22 comprising the knot 24 and may run along the rim of the outer surface of the sidewalls. The second end of the elastic cord may run back through the opposite outer opening 22 as the first end and through the opposite inner opening 22 as the first end, where a second knot 24 is formed, thereby securing the elastic cord 23 to the trash receptacle 21 on the outer surface of the sidewalls. The trash bag 12 may be folded over the rim of the trash receptacle 21 and secured in between the elastic cord 23 and the trash receptacle 21.

In embodiments as illustrated in FIGS. 9 through 12, the present disclosure may include four openings 32, including two outer openings 32 and two inner openings 32, just below the rim of one of the sidewalls. The elastic cord 33 may include a first end and a second end. The first end and the second end may be tied together to form a knot 34 and may rest on the outer surface, with the elastic cord 33 running through both of the inner openings 32. The elastic cord 33 may run through a first inner opening 32 from the knot 34 and then through the outer opening 32 closest to the first inner opening 32. The elastic cord 32 may run along the rim of the outer surface of the sidewalls. The second end of the elastic cord 33 may run back through the opposite outer opening 32 as the first end and through the second inner opening 32, where the second knot 34 is formed with the first end of the elastic cord 33, thereby securing the elastic cord 33 to the trash receptacle 31 on the outer surface of the sidewalls. The trash bag 12 may be folded over the rim of the trash receptacle 31 and secured in between the elastic cord 33 and the trash receptacle 31.

In embodiments as illustrated in FIGS. 13 through 16, the present disclosure may include two openings 42, including a first opening 42 and a second opening 42, just below the rim of one of the sidewalls. The elastic cord 43 may include a first end and a second end. The first end may be tied in a knot 44 and may rest within the inner surface of the sidewall. The elastic cord 43 may run through the first opening and along the rim of the outer surface of the sidewalls. The second end of the elastic cord 43 may run through the second opening 42 and may be tied off at a knot 44 within the inner surface of the sidewall, thereby securing the elastic cord 43 to the trash receptacle 41 on the outer surface of the sidewalls. The trash bag 12 may be folded over the rim of the trash receptacle 41 and secured in between the elastic cord 43 and the trash receptacle 41.

In embodiments as illustrated in FIGS. 17 through 20, the present disclosure may include three openings 52, including a first opening 52, a second opening 52 and a third opening 52, just below the rim of one of the sidewalls. The elastic cord 53 may be continuous and unbroken. In such embodiments, the elastic cord 53 may loop through the first opening 52, the second opening 52, and the third opening 52 and wrap around the rim of the outer surface of the sidewalls. The elastic cord 53 may be anchored to receptacle 51 without the use of a stopper and stretched to fit snuggly around the outer sidewall surfaces of trash receptacle 51. The trash bag 12 may be folded over the rim of the trash receptacle 51 and may be secured in between the elastic cord 53 and the trash receptacle 51.

In embodiments as illustrated in FIGS. 21 through 24, the present disclosure may include two openings 62, including a first opening 62 and a second opening 62, just below the rim of one of the sidewalls. The elastic cord 63 may include a first end and a second end. The first end may be tied in a knot 64 and rest within the inner surface of the sidewall. The elastic cord 63 may run from the knot 64 through the first opening in the direction of the second opening and along the rim of the outer surface of the sidewalls. The second end of the elastic cord 63 may run through the second opening 62 and may be tied off at a knot 64 within the inner surface of the sidewall, thereby securing the elastic cord 63 to the trash receptacle 61 on the outer surface of the sidewalls. The trash bag 12 may be folded over the rim of the trash receptacle 61 and secured in between the elastic cord 63 and the trash receptacle 61.

In embodiments as illustrated in FIGS. 25 through 28, the present disclosure may include a single opening 72 just below the rim of one of the sidewalls. The elastic cord 73 may include a first end and a second end. The first end and second end may run through the single opening 72 and may be tied together in a knot 74 within the inner surface of the sidewall. The elastic cord 73 may run out of the opening 72 and along the rim of the outer surface of the sidewalls and back into the opening 72. The trash bag 12 may be folded over the rim of the trash receptacle 71 and secured in between the elastic cord 73 and the trash receptacle 71.

In embodiments as illustrated in FIGS. 29 through 32, the present disclosure may include a single opening 84 just below the rim of one of the sidewalls. The elastic cord 83 may be an unbroken and continuous elastic cord 83. A portion of the elastic cord 83 may protrude into the inner surface of the sidewall, and the portion may be tied into a knot 84. The elastic cord 83 may run out of the opening 82 and may be overlapped upon itself so that it may run along 100% of the entire rim of the outer surface of the sidewalls. The trash bag 12 may be folded over the rim of the trash receptacle 81 and secured in between the elastic cord 83 and the trash receptacle 81.

In embodiments as illustrated in FIGS. 33 through 36, the present disclosure may include three openings 92, including a first outer opening 92, a middle opening 92 and a second outer opening 92, just below the rim of one of the sidewalls. The elastic cord 93 may include a first end and a second end. The first end may include a knot 96 resting on the outer surface of the sidewall and the elastic cord 93 may run through the first outer opening 92. The elastic cord 93 may run from the first outer opening and out of the middle opening 92 and may run along the rim of the outer surface of the sidewalls. The second end of the elastic cord may overlap a portion of cord 93 and run back through the middle opening 92 and out of the second outer opening 92 where a second knot 96 is formed, thereby securing the elastic cord 93 to the trash receptacle 91 on the outer surface of the sidewalls. The trash bag 12 may be folded over the rim of the trash receptacle 91 and may be secured around 100% of the outer rim of receptacle 91 in between the elastic cord 93 and the trash receptacle 91.

In embodiments as illustrated in FIGS. 37 through 40, the present disclosure may include four openings 105, including a first outer opening 105, a first middle opening 105, a second middle opening 105 and a second outer opening 105, just below the rim of one of the sidewalls. The elastic cord 103 may be continuous and unbroken. In such embodiments, the elastic cord 103 may loop through the first outer opening 105, the first middle opening 105, the second middle opening 105 and the second outer opening 105 and wrap around the rim of the outer surface of the sidewalls, thereby simultaneously anchoring the elastic cord 103 to the trash receptacle 101 on a portion of inner and all of the outer surfaces of the sidewalls. The trash bag 12 may be folded over the rim of the trash receptacle 101 and secured in between the elastic cord 103 and the trash receptacle 101.

In embodiments as illustrated in FIGS. 41 through 44, the present disclosure may include two openings 112, including a first opening 112, and a second opening 112, just below the rim of one of the sidewalls. The elastic cord 113 may be continuous and unbroken. In such embodiments, the elastic cord 113 may loop through the first opening 112 and the second opening 112, cross over one another and wrap around the rim of the outer surface of the sidewalls, thereby securing the elastic cord 113 to the trash receptacle 111 on the outer surface of the sidewalls. The trash bag 12 may be folded over the rim of the trash receptacle 121 and secured in between the elastic cord 123 and the trash receptacle 121.

In embodiments as illustrated in FIGS. 45 through 48, the present disclosure may include two openings 122, including a first opening 122 and a second opening 122, just below the rim of one of the sidewalls. The elastic cord 123 may include a first end and a second end. The first end may be tied in a knot 124 and rest on the outer surface of the sidewall. The elastic cord 123 may run from the knot 124 through the first opening and then through the second opening. From the second opening 122, the cord 123 may run back towards the first opening 122 and along the rim of the outer surface of the sidewalls. The second end of the elastic cord 123 may run through the first opening 122 and back through the second opening 122. The second end may be tied off at a knot 124 on the outside surface of the sidewall, thereby securing the elastic cord 123 to the trash receptacle 121 on the outer surface of the sidewalls. The trash bag 12 may be folded over the rim of the trash receptacle 121 and secured in between the elastic cord 123 and the trash receptacle 121.

In embodiments as illustrated in FIGS. 49 through 52, the present disclosure a system 100 may include a receptacle 111 having two openings, including a first opening 112 and a second opening 115, just below the rim of a sidewall of the receptacle 111. The first opening 112 may be disposed directly or substantially directly below the second opening 115 on the sidewall. The first opening 112 and second opening 115 may be in vertical alignment. An elastic cord 113 may include a first end and a second end or may comprise one continuous piece. The first end and the second end may include a knot 96 securing the first end and second end together, such that the elastic cord 113 is folded substantially in half and the cord is doubled-over. The knot 96 may rest on the outer surface of the sidewall and anchor the cord 113 to the receptacle 111. The doubled-over elastic cord 113 may run through the first opening 112 into the receptacle 111 and out of the second opening 115 out of the receptacle 111. The elastic cord 113 may run along the rim of the outer surface of sidewalls of the receptacle 111, thereby securing the elastic cord 113 to the receptacle 111 on the outer surface of the sidewalls. A portion of the cord 113 may be tied in a handle knot 26 that may rest on the outer surface of the sidewall, or the like. The handle knot 26 may be used as a handle to enable the user to easily grab the cord 113 and engage or disengage the cord 113 from the receptacle. A trash bag 12 or plastic liner may be folded over the rim of the trash receptacle 111 and secured in between the elastic cord 113 and the trash receptacle 111.

In embodiments as illustrated in FIGS. 53 through 56, the present disclosure may include two openings, including a first opening 112 and a second opening 115, just below the rim of one of the sidewalls. The first opening 112 may be disposed at an angle below the second opening 115 on the sidewall, thereby increasing the tension in an elastic cord 113 and securing a bag 12 in place. The openings 112, 115 may be arranged at an angle from each other or otherwise offset so an elastic cord 113 and an anchor can be compacted vertically if necessary. The openings 112, 115 may not be lined up perfectly horizontally and/or vertically so that a knot will not interfere with horizontal wrapping of the cord around the basket, container, and/or the like. The openings 112, 115 may be offset at an angle between zero and ninety degrees. An elastic cord 113 may include a first end and a second end or may comprise one continuous piece. The first end and the second end may include a knot 96 securing the first end and second end together, such that the elastic cord 113 is folded substantially in half and the cord is doubled-over. The knot 96 may rest on the outer surface of the sidewall and anchor the cord 113 to the receptacle 111. The doubled-over elastic cord 113 may run through the first opening 112 into the receptacle 111 and out of the second opening 115 out of the receptacle 111. The elastic cord 113 may run along the rim of the outer surface of sidewalls of the receptacle 111, thereby securing the elastic cord 113 to the receptacle 111 on the outer surface of the sidewalls. A portion of the cord 113 may be tied in a handle knot 26 that may rest on the outer surface of the sidewall, or the like. The handle knot 26 may be used as a handle to enable the user to easily grab the cord 113 and engage or disengage the cord 113 from the receptacle. A trash bag 12 or plastic liner may be folded over the rim of the trash receptacle 111 and secured in between the elastic cord 113 and the trash receptacle 111.

In embodiments as illustrated in FIGS. 57 through 60, the present disclosure may include two openings, including a first opening 112 and a second opening 115, just below the rim of one of the sidewalls. The first opening 112 may be disposed below the second opening 115 on the sidewall. An elastic cord 113 may include a continuous loop. The cord 113 may be doubled up and passed through both openings 112, 115 and then looped around itself and anchored by a portion of a sidewall between the two openings, and/or the like. The elastic cord 113 may run from a looped knot 26 through the first opening 112 and then through the second opening 115. From the second opening 115, the cord 113 may run along the rim of the outer surface of the sidewalls. In some embodiments, a looped knot 26 may be tied off on the outside surface of the sidewall. A trash bag 12 may be folded over the rim of the trash receptacle 111 and secured in between the elastic cord 113 and the trash receptacle 111.

In some embodiments, some or all of the components described herein may be packaged as a "conversion kit" for existing trash receptacles, or the like. The conversion kit may comprise the elastic band, a guide paper or template for demonstrating to a user where the openings should be placed, a set of instructions, a cord lock, a washer, a reinforcing member, any component described herein or consistent with the present disclosure, or the like. In some embodiments, the conversion kit may simply comprise one component, any combination of components, or all components described herein and/or consistent with the present disclosure.

A method of using the present disclosure may include the following. A user may start by pulling the bungee cord up and off of the outer rim of the trash receptacle. The next step is to slowly release the tension on the cord and set it aside on the outside of the back panel of the receptacle. At this point, one may open an empty trash bag and place it inside the receptacle folding the top 1-2" of the bag over the top and outside rim of the receptacle. One may then grab the bungee cord, cross over itself at back (near anchor point on back panel) and place it over the plastic bag and just under the top rim of receptacle. The bungee may rest snuggly against both the plastic bag and the receptacle encircling up to 100% of the rim while holding the bag open and secure. When the bag is full, one may pull the loop handle away and up over the top of the receptacle. One may slowly release and gently remove the unanchored portion of the bungee cord away from rim. Finally, one may remove and discard the full trash bag and replace it with new empty garbage bag as described previously.

Additionally, the present disclosure may be useful for the collection of industrial and medical waste and/or incorporation with trash receptacles other than those described in detail above such as receptacles with attached or detached lids, or those with foot-pedal powered "flip-lids" and the like. The present disclosure may also be used in the storage of food or other items wherein the bungee cord incorporates a plastic or cloth sheet sewn to its stretched top and in the exact shape of the receptacle container (be it round, square, rectangular or whatever) thus making a virtually air tight container but without use of a hard top.

It should be understood, that the foregoing relates to exemplary embodiments of the invention and that modifications may be made without departing from the spirit and scope of the invention as set forth in the following claims. It should be emphasized that the above-described embodiments of the present disclosure are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

While the foregoing is directed to embodiments of the present disclosure, other and further embodiments of the invention may be devised without departing from the basic scope thereof. For example, although numerous embodiments having various features have been described herein, combinations of such various features in other combinations not discussed herein are contemplated within the scope of embodiments of the present disclosure.

What is claimed is:

1. A plastic liner securing system comprising:

a receptacle comprising at least one sidewall comprising an outer surface and an inner surface, wherein a receptacle is formed within the inner surface, wherein the at least one sidewall comprises an outer rim forming an entrance leading into the receptacle, and wherein two openings are formed through a single side of the at least one sidewall in vertical alignment, the two openings comprising a lower opening and an upper opening, the upper opening positioned above the lower opening and closer to the outer rim;

an elastic cord attached to the receptacle through the two openings, the elastic cord having a first end and a second end, the first end and the second end tied in a securing knot whereby the elastic cord is folded and doubled over, the securing knot anchoring the elastic cord to the receptacle on the outer surface of the receptacle adjacent to the upper opening, wherein the elastic cord passes through the lower opening into the receptacle and out of the upper opening; and wherein the elastic cord is sized and positioned to fit around the outer rim and over a plastic liner such to secure the plastic liner to the outer rim.

2. The plastic liner securing system of claim 1, further comprising at least one of a looped handle, a knot, or a cord lock disposed on the elastic cord to assist a user in grabbing the elastic cord and pulling the elastic cord around the outer rim and over the plastic liner.

3. A plastic liner securing system comprising:

a receptacle comprising at least one sidewall comprising an outer surface and an inner surface, wherein the at least one sidewall comprises an outer rim forming an entrance leading into the receptacle, and wherein two openings are formed through a single side of the at least one sidewall, the two openings comprising a first opening and a second opening, the second opening offset at an angle between zero and ninety degrees from a vertical plane through the first opening;

an elastic cord attached to the receptacle through the two openings, the elastic cord having a first end and a second end, the first end and the second end tied in a securing knot whereby the elastic cord is folded and doubled-over, the securing knot anchoring the elastic cord to the receptacle on the outer surface of the receptacle adjacent to the first opening, wherein the elastic cord passes through the first opening into the receptacle and out of the second opening; and wherein the elastic cord is sized and positioned to fit around the cuter rim and over a plastic liner such to secure the plastic liner to the outer rim.

4. The plastic liner securing system of claim 3, further comprising at least one of a looped handle, a knot, or a cord lock disposed on the elastic cord to assist a user in grabbing the elastic cord and pulling the elastic cord around the outer rim and over the plastic liner.

5. A plastic liner securing system comprising:

a receptacle comprising at least one sidewall comprising an outer surface and an inner surface, wherein the at least one sidewall comprises an outer rim forming an entrance leading into the receptacle, and wherein two openings are formed through a single side of the at least one sidewall, the two openings comprising a lower opening and an upper opening, the upper opening positioned above the lower opening and closer to the outer rim;

an elastic cord forming a continuous loop attached to the receptacle through the two openings, wherein the continuous loop is doubled up, passed through both openings, and looped through itself and anchored to a portion of the sidewall positioned between the two openings on the outer surface of the receptacle adjacent to the lower opening; and wherein the elastic cord is sized and positioned to fit around the outer rim and over a plastic liner such to secure and circumnavigate the plastic liner to the outer rim.

6. The plastic liner securing system of claim 5, further comprising at least one of a looped handle, a knot, or a cord lock disposed on the elastic cord to assist a user in grabbing the elastic cord and pulling the elastic cord around the outer rim and over the plastic liner.

* * * * *